United States Patent [19]

O'Brien

[11] 4,182,237

[45] Jan. 8, 1980

[54] METHOD AND APPARATUS FOR STACKING BATTS IN COMPRESSIBLE COLUMNS

[75] Inventor: Theodore E. O'Brien, Sarnia, Canada

[73] Assignee: Candu Packing (Ontario) Limited, St. Thomas, Canada

[21] Appl. No.: 970,355

[22] Filed: Dec. 18, 1978

[51] Int. Cl.[2] ..... B30B 15/30

[52] U.S. Cl. ..... 100/35; 53/438; 53/529; 100/209; 100/215; 100/218; 100/288

[58] Field of Search ..... 53/438, 529; 100/35, 100/215, 218, 209, 295, 240, 245, 226, 288, 255

[56] References Cited

U.S. PATENT DOCUMENTS

| | | | |
|---|---|---|---|
| 3,874,281 | 4/1975 | Conner | 100/35 |
| 3,908,539 | 9/1975 | O'Brien | 100/226 X |
| 3,977,155 | 8/1976 | Spaulding | 100/226 X |
| 4,094,130 | 6/1978 | Kelly | 100/215 X |
| 4,099,363 | 7/1978 | Wistinghausen | 100/226 X |

FOREIGN PATENT DOCUMENTS

| | | | |
|---|---|---|---|
| 952495 | 8/1974 | Canada | 53/529 |

*Primary Examiner*—Billy J. Wilhite

[57] ABSTRACT

Batts are sequentially delivered to a reception station and deposited in columnar order on a platen substantially in one continuous movement in one plane while said platen is advancing from said reception station towards an ejection chamber spaced therefrom in steps commensurate with the delivery rate and thickness of the batts; a preceding batt column previously disposed in the ejection chamber being compressed by the advancing platen and thereafter expelled, while compressed, into a prepared bag.

15 Claims, 9 Drawing Figures

METHOD AND APPARATUS FOR STACKING BATTS IN COMPRESSIBLE COLUMNS

The invention relates broadly to apparatus and methods for use in the stacking and bagging of large batts of compressible material, namely, fibrous thermal insulation.

BACKGROUND OF THE INVENTION

By way of example, a batt as herein contemplated frequently equals and at times exceeds 5 inches in thickness; from 20 to 50 of such batts being normally compressed to fit within a bag measuring perhaps 15 inches in the corresponding dimension. It is well known in the art to stack such batts in groups or columns which are then compressed and, while held compressed, are pushed into a bag whose mouth is held open by a spout through which the batts enter the bag. Generally similar techniques and equipment for carrying out these procedures are disclosed in VACHON, Can. Pat. No. 952,495; in CONNER et al U.S. Pat. No. 3,874,281; in SPAULDING U.S. Pat. No. 3,977,155 in O'BRIEN U.S. Pat. No. 3,908,539 as well as in others of less relevance. Each of these disclosures described a construction in which the batts are generally transported down a chute on a platen, being then delivered into a compression chamber at the bottom of the chute and the platen being withdrawn sideways from the bottom of the chute and being returned, thereafter, to the top of the chute which it re-enters and down which it travels again to compress the batts in the compression chamber which are then ejected into bags as aforesaid.

In each of the disclosures aforesaid a preselected number of batts are stacked in columnar order, compressed, and bagged while under compression. Batts are sequentially delivered to stacking apparatus by means of a conveyor arranged preferably, to accomodate the output of batt producing equipment which, together with the conveyor and the compressing apparatus, thus form an operative chain and, for greatest efficiency, should therefore operate continuously in timed relation to each other at their respective capacities in order to avoid pile-ups along the line.

Normally, such consistency and continuity would be quite feasible if all other relevant factors remain constant and if each link in the chain operated reliably and uniformly without failure.

DISCUSSION OF THE PRIOR ART

Usually, the bottlenecks with respect to continuity and efficiency arose heretofore in the stacking and compressing equipment.

For example, in three of the enumerated prior disclosures, the batts delivered by the conveyor were received by some intervening facility which then, in turn, added them to a stack being formed. Since this constituted a step in the operative procedure, the timing of this step and the uniformity of its function were relatively important to the operation as a whole.

In all relevant prior art known to the applicant herein, the batts delivered by the conveyor were dropped onto the stack or column in the process of formation which almost inevitably resulted in misalignment to a greater or lesser degree of newly arrived batts with respect to their predecessors. Thus, it was rare to find a column of batts stacked by prior devices in which all the respective batts were symmetrically aligned with each other. Hence, when duly compressed, prior columns frequently presented a ragged and irregular format which not only hampered and frustrated the bagging thereof but, oftentimes was actually productive of defective bagging.

In turn, this situation tended to slow down the handling of the batts, whether by necessity or otherwise, between the time of their delivery to the conveyor and the completion of the bagging operation.

OBJECTS OF THE INVENTION

The invention, accordingly, has as its broad object, the provision of method and means for aligning sequentially delivered batts in substantial registration with each other in generally symmetrical columns and for compressing such columns in an ejection chamber for expulsion therefrom into a prepared bag.

More specifically, the invention seeks to provide method and apparatus for depositing sequentially delivered batts on columns in the process of formation by placing them rather than by dropping them on the columns.

In particular, the invention seeks to provide method and means for improved efficiency and versatility in the processing of batts as aforesaid from their point of origin to their expulsion into prearranged bags.

SUMMARY OF THE INVENTION

The invention achieves the foregoing and other unstated but obvious objects by successive cycles of operation respectively including the steps of disposing a platen at a reception station at the rear end of a leading column of batts; delivering batts sequentially to said station and placing them on said platen to form thereon a succeeding column in co-axial alignment with the leading column, the delivery and placement of each sequential batt being, optimally, effected in one continuous movement; disposing the front end of the leading column in an ejection chamber having an opening through which it is entered by said column; advancing said platen with the next succeeding column towards the ejection chamber to compress the leading column of batts within the chamber; arresting said platen in an occluding position at the opening of said ejection chamber and maintaining it in such occluding position while the compressed batts are being expelled from said ejection chamber and, thereafter, withdrawing said platen from said opening in a direction normal to the path of advancement of the batts from the reception station to the ejection chamber and so re-opening the ejection chamber to receive the front end of the next succeeding column of batts which, thus, becomes the new leading column; the next succeeding cycle of operations being initiated prior to the aforesaid withdrawal of said platen.

It should, perhaps, be pointed out at this juncture that, under optimum conditions, each batt delivered to the reception station would be placed on the platen (or on a preceding batt on the platen) in a continuation of the movement of its delivery and optimally, in the plane of that movement; the purpose of this precaution being to avoid dropping arriving batts onto the platen and thus, probably, misaligning them. On the other hand, a very short drop on the order of two or three inches would not cause harmful misalignment and a batt dropped this short distance at the reception station is still herein considered as having been placed on the platen substantially in the plane of its delivery to the reception station.

The invention further visualizes that the platen and the column being formed thereon will be advanced towards the ejection chamber as aforesaid in steps carefully timed to correspond to the delivery and deposit of said batts and carefully spaced commensurately with the thickness of the batts to maintain the rear end of the column relatively flush with the reception station at all times during an operative cycle.

Still further contemplated by the invention is the redisposition of the withdrawn platen at the reception station at the rear end of a new leading column of batts, initiating a new cycle of operations.

Expediently, apparatus in accordance with the invention may employ two platens which simultaneously traverse respective closed paths which overlap within the chute or duct through which batts are channelled from the reception station to the ejection chamber in which they are compressed; one platen being moved to compress the batts in the chamber while the other leads a fresh group of batts through the duct towards the ejection chamber.

Preferably each platen performs a dual transport and compressing function during each traversal; advancing a fresh batt column to the ejection chamber while compressing a preceding column in the ejection chamber. As has been said, the movement of the platen along the duct is indexed in a step-wise manner so that as each batt is delivered to a platen, (or to a column in the process of formation on a platen) the latter moves an appropriate distance to accomodate placing (rather than dropping) the next batt on the one immediately preceding it. The speed of operation which may be achieved with the invention is such as enable its synchronisation with the rate at which the batts are being delivered.

BRIEF DESCRIPTION OF THE DRAWINGS

The invention will now be described merely by way of example in relation to a drawing of a selected embodiment thereof in which.

DESCRIPTION OF THE EMBODIMENT

According to the invention resilient batts B are prepared for packaging by being first organized in aligned columns C; said columns C being subject to successive cycles of operations, to be later described, whereby the batts B comprised in the columns C are compressed in an ejection chamber E from which they are expelled into a pre-arranged bag.

Neither the explusion means nor the bag form part of the present invention; being already well-known in the prior art as is, indeed, the ejection chamber E, as well.

The nature of the compression phase will be appreciated from the fact that an average batt B may have a thickness of 5 inches, more or less, and that as many as 50 or more of such batts may be compressed to fit into a single bag having a corresponding dimension of, say, 15 inches; it being understood that these figures are exemplary only and not limiting on the invention in any sense.

The figures do bring out, however, the importance of reasonably precise alignment of batts in columns C since misalignment would very seriously hamper the bagging of batts which are so highly compressed.

Figure 3:
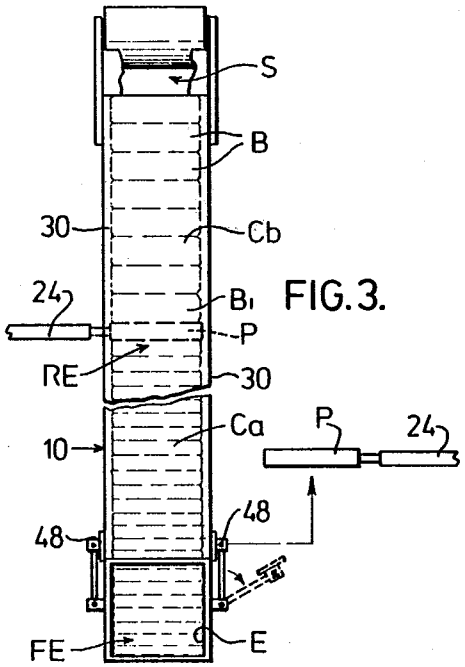
FIG. 3 is a view in end elevation showing a duct as contemplated by the invention at an intermediate sage in the process.

Preliminary to, or at an early point in, each cycle of operations, the leading or front end FE of a batt column C is installed and disposed in ejection chamber E as shown in FIG. 3.

Figure 2:
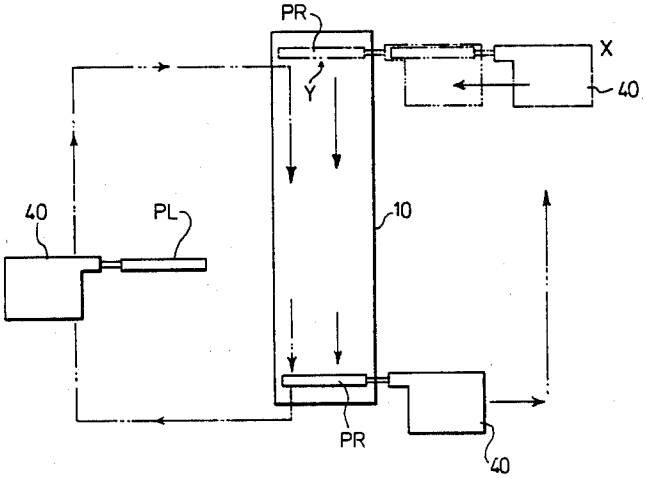
FIG. 2 is a schematic outline of the paths of the two platens aforesaid.

Quite obviously, the invention proposes to work on successive columns C of batts B; each cycle of operations, as aforesaid, being followed immediately and without delay by another and may in fact, be overlapped thereby as indicated in FIG. 2.

For the sake of clarity, each column C, being or about to be compressed, is herein termed the leading (for the time being) column Ca of batts B; those following being termed succeeding or successive columns Cb; each becoming a leading column Ca in its turn.

At the commencement of each cycle of operations, a platen P is disposed at the rear end RE of a leading batt column Ca whose front end FE is already or shortly thereafter disposed in ejection chamber E through an opening O of appropriate dimension provided therein.

Figure 5:
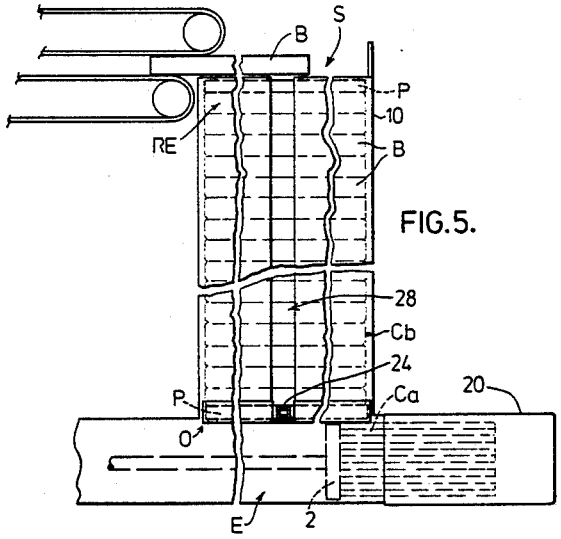
FIG. 5 is an elevational view in somewhat schematic form of the apparatus at the initiation of a cycle of operations.

At the commencement of a cycle of operations, said platen P is disposed as aforesaid at a reception station S to which successive batts B are delivered in fairly rapid sequence by means such as the conveyor shown in the drawing, for example at FIG. 5.

When first disposed at reception station S, the platen P is located in substantially the same plane as that in which batts B are being delivered thereto whereby the next batt B reaching the reception station is deposited on the waiting platen P immediately in the same motion and, virtually, in the same plane in which it is delivered to reception station S as shown in said FIG. 5.

It should be pointed out that only the first batt B at the front end FE of a column C is deposited directly onto platen P; its successors being each thereafter respectively deposited directly on a preceding batt B and, sequentially, on each other subsequently deposited batt B to form a fresh column C on platen P. To all intents and purposes, each such batt deposited on column C is herein equated with being deposited on platen P.

By means hereinafter described, platen P with column C formed thereon is advanced continuously away from reception station S towards ejection chamber E even as and while batts B are being delivered to and deposited thereon; the advancement of the platen P being accomplished in steps timed to correspond to the rate at which batts B are delivered thereto and being dimensioned to correspond to the average thickness of the batts so that as each sequential batt B arrives at the reception station, its delivery and deposit can be effected in a continuous movement and substantially in one plane, as has been described and as will be apparent from FIGS. 5 and 3.

It would be useful, perhaps, at this juncture to comment on the significance of the manner in which each sequential batt B is added to the column C in the course of its formation.

It has already been pointed out that the misalignment of batts in a column creates problems when the column is compressed and thrust into a bag. Such bag is usually dimensioned to snugly accomodate batts in general registration with each other and, hence, the frustration which occurs when the corners of one or more misaligned batts project from the column will be well understood.

Usually, duct in which the batt columns are formed is dimensioned to accomodate the batts relatively snugly as an aid to their alignment. When, however, the batts are dropped onto a column from a height exceeding, say, 3 or 4 inches, it is not uncommon for them to land badly and out of alignment. These problems are avoided by depositing or laying each succeeding batt on column C in contradistinction to dropping it thereon and it is for this reason that the invention seeks to ensure with respect to each column C that the rearmost batt at the rear end RE of the column will be at a position which will permit the next arriving batt to be deposited directly thereon virtually in the same movement and in the same plane of its delivery to reception station S. It is to this end that the invention is pre-occupied with the initial placement of the platen at the reception station and its advancement from reception station S towards ejection chamber E in steps which correspond in time and space to the arrival and thickness of succeeding batts.

In the course of its advancement from the reception station S to ejection chamber E, platen P not only makes way for further batts but simultaneously achieves compression of the leading batt column Ca in said ejection chamber E in which the front end FE of that column is already disposed.

This phase of the operative cycle is illustrated in FIG. 3 in which will be seen batts B being delivered to and deposited on a platen P to form a succeeding column Cb while the platen P advances towards the ejection chamber E; making room for the accomodation of fresh batts B at the reception station S and, at the same time, compressing the leading batt column Ca in the ejection chamber E.

In due course, as will be appreciated, advancing platen P will have pushed the entire column Ca into and compressed it in the ejection chamber E while an entirely new column Cb has been formed on platen P.

Figure 6:
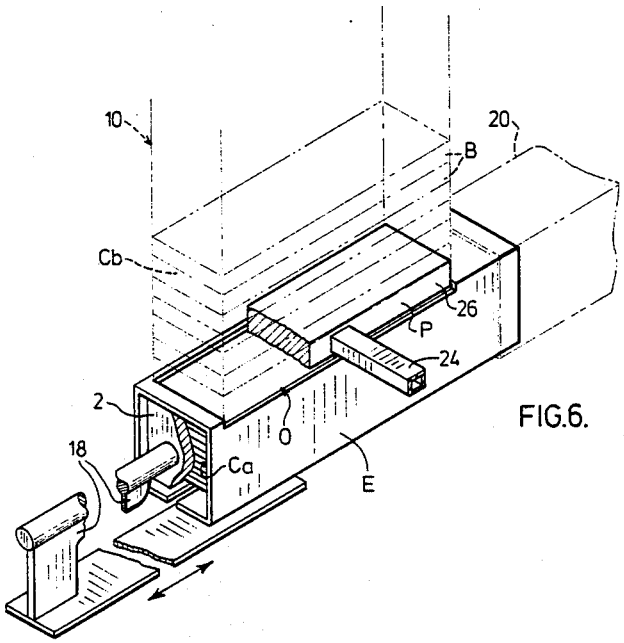
FIG. 6 is an isometric view, partly broken and partly in phantom form, of the ejection chamber associated with the invention at or near the end of a cycle of operations.

At this juncture, platen P will have reached opening O in ejection chamber E much as shown in FIG. 6.

In effect, platen P thus forms a closure for the ejection chamber E; completing the latter so that the batts B compressed therein may be expelled therefrom as by ram 2 shown in standby position in said FIG. 6 and in operation in FIG. 5.

It need scarcely be stated that the movements of the platen P are timed by conventional electronic apparatus 4 which forms no part of this invention except to the extent of timing the various functions comprised in a cycle of operations aforesaid.

That is to say, the prior art is replete with various devices capable of initiating, arresting and directing movements of affiliated apparatus and any of such devices may be adapted for use in conjunction with the present invention.

Thus such timing apparatus 4 is adjusted to procure arrest of platen P at opening O of ejection chamber E and to maintain it in chamber-closing position while the compressed batts are being expelled therefrom after which it procures withdrawal of platen P, thereby reopening ejection chamber E, and thus permitting the succeeding batt column Cb formed thereon to enter the ejection chamber E as the new leading column Ca. While these events are transpiring, fresh batts B will continue to be piled on column C.

Prior to the withdrawal of the platen P from its chamber-closing position, a fresh platen will have been disposed at the reception station S at the rear end RE of the column Cb immediately succeeding the leading column Ca thereby initiating a fresh cycle of operations similar to that just described.

After its withdrawal from chamber-closing position, the platen P is moved back to its starting point for redisposal at the reception station S.

As has been pointed out any platen P disposed at the reception station S according to the invention is situated to permit arriving batts B to be deposited directly on it in a continuous mono-planar movement. Similarly such platen should be located at the rear end of the preceding batt column C in a position to apply an advancing thrust thereto as it advances towards ejection chamber E.

The invention visualizes that it may sometimes be necessary to hold a newly arrived platen temporarily in a standby position pending an optimal time for its re-disposition at the reception station S; this optimal time being, for example, when a fairly full column C has not yet been assembled on the immediately preceding platen.

Of course, deferring the re-disposition of a platen is not essential and, in fact, it would be expedient at all times to re-dispose the platen P as aforesaid immediately upon its return to the reception station S provided, of course, that a sufficient number of batts B have been deposited on the preceding column C.

It will be apparent from what has been said, that in its simplest form, the invention contemplates the use of two platens which function substantially identically to each other in alternating cycles. To facilitate this, each platen is withdrawn as aforesaid in a direction which is normal to the columnar axis and is re-disposed at the reception station by a reverse movement; each such movement taking place on one side of the path pursued by column C in its advance towards ejection chamber E; the two platens being, of course, manipulated on different—and preferably, opposite—sides of the column pathway.

It will be further apparent that each said cycle of operations comprises disposing a platen P at the reception station S; depositing batts B thereon while the platen P is advanced towards a position in which it acts as a closure for ejection chamber E; withdrawing said platen P to one side of its path of advancement from reception station S to ejection chamber E, and thereafter transporting it back to the beginning of that path for re-disposal at said reception station S.

Each movement of the platen P is controlled by timing device 4 which, obviously, may also control the ram 2 which expels the compressed batts B from ejection chamber E as well as other paraphernalia associated with the present apparatus and may, when desired, by regulated to enhance the versatility of the invention, e.g., to occasionally skip an expulsion phase between two successive cycles.

In addition to the parts already described, the apparatus of the invention also comprises a conduit or duct 10 which communicates and provides a passageway between reception station S and ejection chamber E. The duct 10 is proportioned and cross-sectionally shaped to conform rather closely to the planar dimensions of batt B whereby to ensure their alignment in registration with each other thereby facilitating the bagging thereof under compression much as suggested by FIG. 6.

It should also be observed that the length of duct 10 between reception station S and ejection chamber E is a factor in the axial dimension of column C and, hence, in the number of batts B comprised therein.

It will be recalled that each platen is disposed at reception station S—i.e., at the inlet 12 of duct 10—at the initiation of a cycle of operations and is withdrawn from chamber-occluding position at outlet end 14 of duct 10; the aforesaid disposition of each platen P and its withdrawal being thus obviously effected at opposite ends of duct 10 and at one side thereof. In FIG. 2, the platen therein identified as PR moves from outlet 14 to inlet 12 at the right of the view while its companion moves on the left side and is hence identified as PL; they being withdrawn from chamber occluding position and re-disposed at the reception station from the same, respectively opposite, sides of duct 10.

Figure 4:
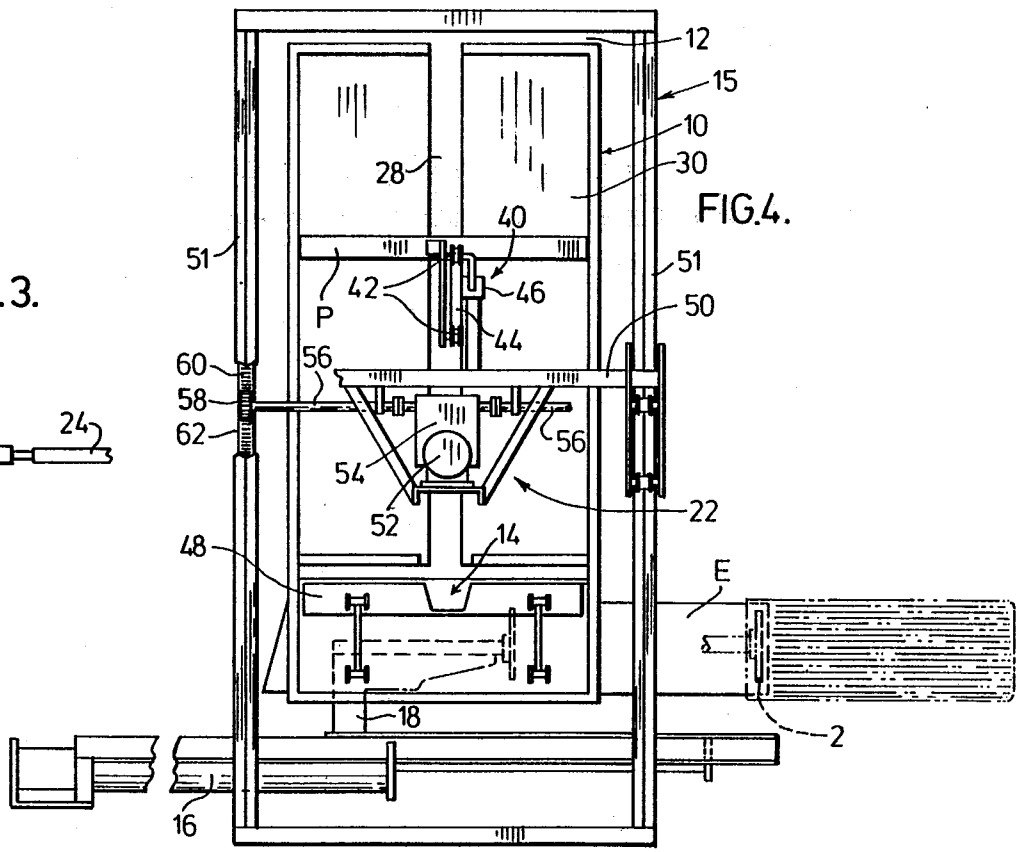
FIG. 4 is a view in elevation of a side of the apparatus of FIG. 1 with certain parts broken away and thus removed to reveal otherwise hidden details.

In FIGS. 4 and 5, for example will be seen openings accommodating disposition of one of the platens P at the duct inlet 12 and its withdrawal at the duct outlet 14; a corresponding set of openings being provided for the second platen P. It will also be recalled that respective cycles of operations of the two platens PL and PR are substantially identical to each other. Thus, this description of the apparatus affiliated with one platen P will also serve adequately to describe the companion apparatus associated with the companion platen P.

Although much of the apparatus of the invention will have been apparent by the foregoing description of the method, it should, nevertheless, be particularly pointed out that the various parts of the apparatus are assembled on a frame 15 (FIG. 1) which contains the duct 10 (not shown in this view) traversed by platens PL and PR in overlapping paths and in which the batt columns C are advanced from reception station S to ejection chamber E which communicates with and actually forms the dead end of duct 10.

Figure 8:
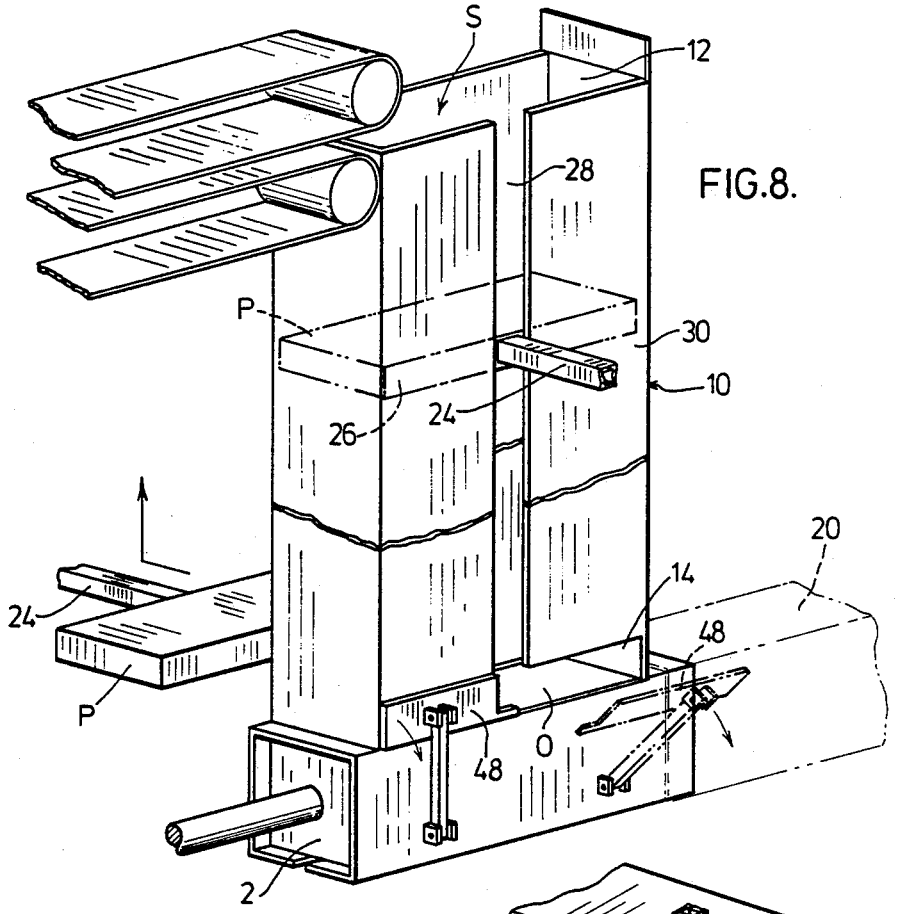
FIG. 8 is a perspective view of a part of the apparatus of FIG. 1 showing, in skeletal form, the duct, the ejection chamber, the platens and related equipment.

Notwithstanding that it does not form part of the inventions, it may yet be useful to note that ram 2 has a piston/cylinder relationship with ejection chamber E; being shown in stand-by position in FIG. 6 and 8 preparatory to expelling the compressed batts B into the open bag 20 waiting at the right of FIGS. 5 and 6; it being further noted that the ram 2 is reciprocable in ejection chamber E by pump 16 connected to arm 18 on which ram 2 is mounted.

Figure 1:
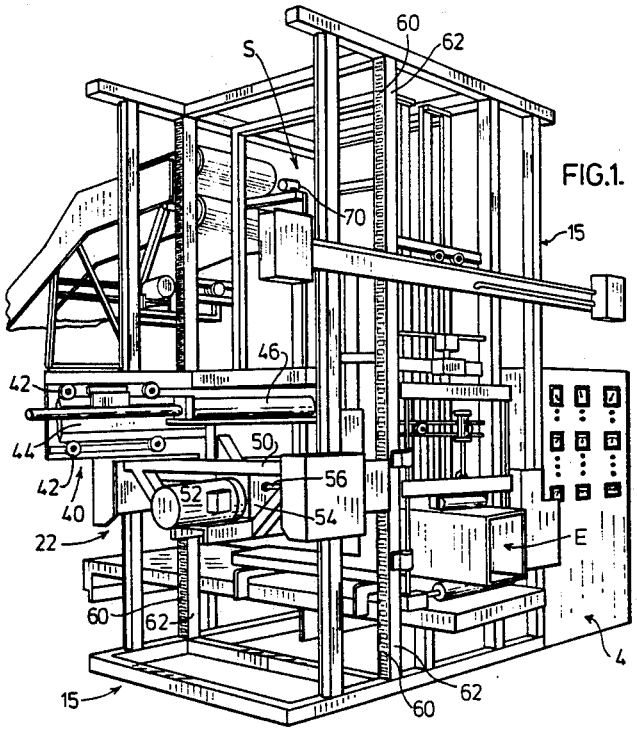
FIG. 1 is a general isometric orientation view of apparatus embodying the invention with many of the parts removed to show otherwise hidden detail.

It will be appreciated that all functions of ram 2, including its forward and reverse strokes in ejection chamber E, are initiated and governed by the control apparatus 4 shown at the right of FIG. 1 and which also controls the movements of the respective platens PL and PR, their positioning at reception station S; dwelling in opening O of ejection chamber E, and their withdrawal from and re-entry into duct 10.

Figure 7:
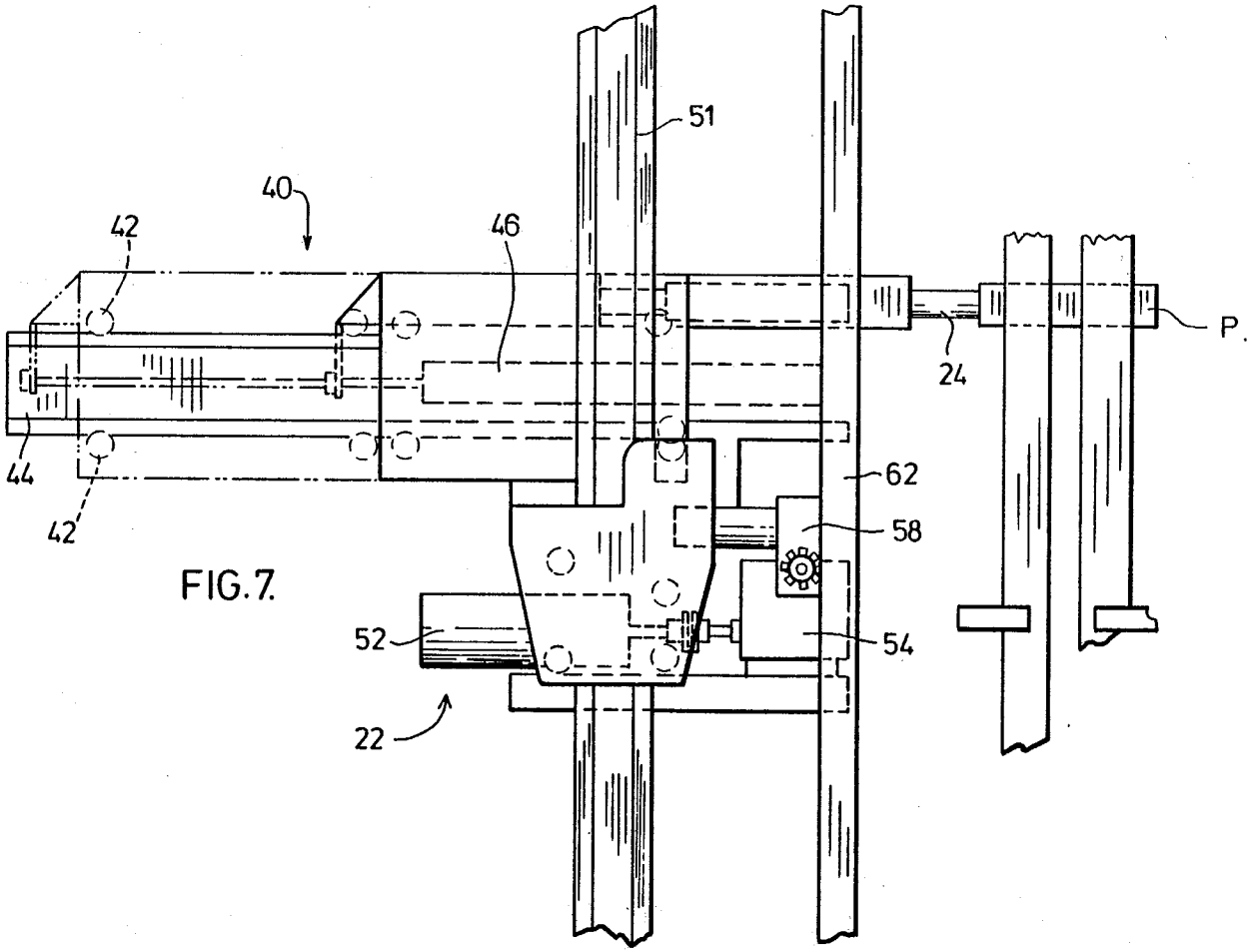
FIG. 7 is an enlarged side elevational view of some of the structure shown in FIG. 4.

In FIGS. 4 and 7, the platen P at the left side of frame 15 in the orientation view of FIG. 1 is illustrated in association with its elevator assembly 22 to be later described which includes the supporting bar 24 which is centrally secured to and projects from the side edge 26 of the platen P and which, when platen P is within duct 10, moves with clearance in a slot 28 provided in wall 30 of duct 10.

Figure 9:
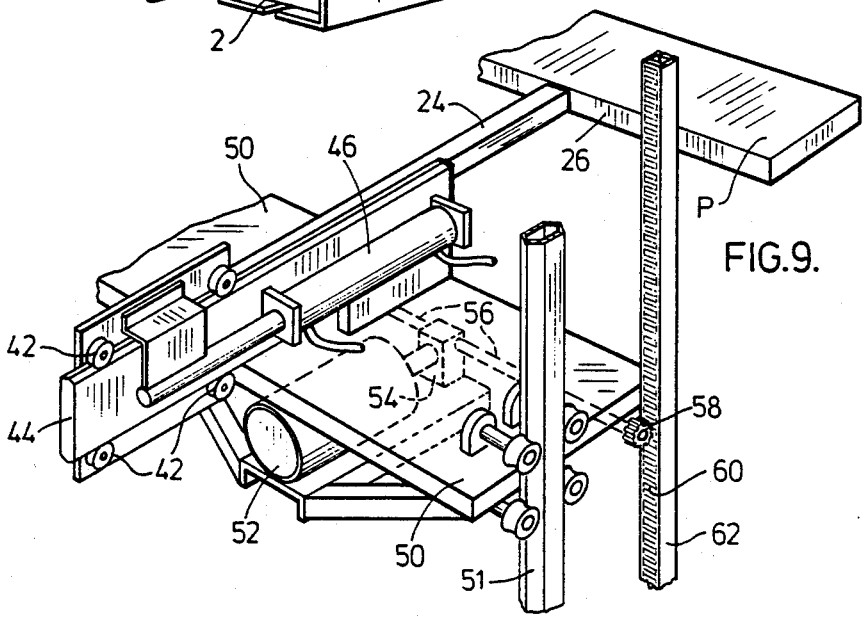
FIG. 9 is an enlarged perspective view of a part of the platen transport assembly of FIGS. 4 and 7.

Bar 24 forms part of a carriage 40 which moves towards and away from duct 10 and forms part of elevator assembly 22; said carriage 40 being equipped with a complement of rollers 42 which engage and ride on a rail 44 towards and away from duct 10 persuant to the commands of control apparatus 4 given to the piston/-cylinder motor 46 operating between carriage 40 and rail 44 on which it is mounted as best shown in FIG. 9.

By this means, the platen P is caused to enter duct 10 at inlet 12 adjacent reception station S and to dwell in opening O of ejection chamber E as in FIG. 6 and to be withdrawn from duct 10 through outlet 14 at the end of duct 10 opposite reception station S; said outlet 14 being normally closed by closure member 48 which is deflectible as shown in dotted lines in FIGS. 3 and 8 to permit passage of platen P therethrough and is spring loaded to re-close outlet 14 when the withdrawal of platen P has been completed as shown on the left of FIG. 8 and in FIG. 4.

The elevator assembly 22, per se, includes a table member 50 which spans the frame 15 from frame post 51 on one side to frame post 51 on the opposite side of frame 15; which it engages through trolleys as shown in FIGS. 1 and 4. Although one end of table 50 has been broken away in FIG. 4. The rail 44 is disposed and secured on one surface of table 50 and a reversible motor 52 is disposed on and secured to its opposite surface. Said motor 52 is associated with a conventional gear box 54 from which project oppositely directed drive shafts 56—56 respectively mounting pinions 58—58 which mesh with racks 60—60 on frame members 62—62 whereby it will be seen that rotation of pinions 58—58 in one sense will move the entire elevator assembly 22 in one direction between reception station S and ejection chamber E while the reverse sense will move it in a reverse direction; the rotation and its sense being started, stoped and selected by the control apparatus 4 as will be understood.

It will be further understood, that an elevator assembly 22 is provided for each of the platens P.

The paths of the respective platens are shown schematically in FIG. 2 in which the duct 10 appears in vertical orientation as it does, indeed, in all other views of the drawing; the platens being respectively disposed on the left and right sides of this view and herein identified as PL and PR.

Dealing firstly with the platen PR at the right hand side of this view, it will be seen that carriage 40 may hold platen PR either in stand-by position x at the top (reception station S) of duct 10 or dispose it in the duct at position y; the elevator assembly 22 thereafter advancing the platen PR downwardly in steps, as already described, towards the bottom of duct 10 (ejection chamber E). In the course of its traverse of duct 10 from reception station S to ejection chamber E, either platen PL or PR may be loaded with batts B forming a new column Cb and will, at the same time, compress a preceding column Ca previously disposed in ejection chamber E. While a preceding column Ca is being cleared from ejection chamber E as shown in FIG. 5, for example, it will be contained in said ejection chamber E by one platen P. In the meantime, its companion platen P will have entered duct 10 at reception station S and will commence taken delivery of sequentially arriving batt B while, at the same time, engaging the rear end RE of a preceding column Cb shortly to be installed in ejection chamber E when the preceding platen has been withdrawn as shown in FIG. 3.

Incidentally, it is reiterated that all of the actions and functions just described are initiated and controlled by the control apparatus 4 which is assisted by suitable counting means 70 of any well known type which is arranged to count batts being delivered to reception station S and to report the count to the control apparatus 4 with which it is interconnected in a well-understood—although, not shown—manner.

Indeed, all connections between the control apparatus 4 and the other parts of the apparatus have been omitted; they being well known and understood in any event.

What I claim is:

1. Method of preparing and presenting columns of aligned, resilient, batts for packaging, comprising successive cycles of operations respectively including the steps of:

disposing a platen at a reception station at the rear end of a leading column of batts; delivering batts sequentially to said station and depositing them on said platen to form thereon a succeeding column in co-axial alignment with the leading column, the delivery and deposit of each sequential batt being effected substantially in one continuous movement in one plane;

disposing the front end of the leading column in an ejection chamber having an opening through which it is entered by said column;

advancing said platen with the next succeeding column towards the ejection chamber to compress the leading column of batts within said chamber;

arresting said platen in an occluding position at the opening of said ejection chamber and maintaining it in such occluding position while the compressed batts are being expelled from said ejection chamber and, thereafter withdrawing said platen from said opening in a direction normal to the axis of the next succeeding column of batts and so re-opening the ejection chamber to receive the front end of the next succeeding column of batts which thus becomes the leading column; the next succeeding cycle of operations being initiated prior to the aforesaid withdrawal of said platen.

2. The method defined in claim 1, including:

advancing said platen as aforesaid in steps timed to correspond to the delivery and deposit of said batts; said steps being spaced commensurately with the thickness of the batts.

3. The method defined in claim 1 or 2, including the steps of:

re-disposing the withdrawn platen at said reception station at the rear end of a new leading column of batts initiating a new cycle of operations.

4. The method defined in claim 1 or 2 including the step of holding the withdrawn platen temporarily at a stand-by position and then re-disposing it at said reception station at the rear end of a new leading column of batts and in receiving relation to batts forming a succeeding column.

5. The method as defined in claim 1, wherein the platen is disposed as aforesaid at the initiation of one cycle of operations from one side of the column and is subsequently withdrawn from the same side; another platen being disposed at the reception station as aforesaid in the next succeeding cycle of operations and being thereafter withdrawn from another side of the column.

6. The method as set forth in claim 5, wherein the said sides of the column are respectively opposite each other.

7. The method as set forth in claim 1 wherein successive cycles of operations overlap each other.

8. The method as set forth in claim 1 wherein the withdrawn platen is re-deposited at said reception station in the second cycle of operations succeeding that in which its withdrawal was effected.

9. The method defined in claim 1, 2 or 3 wherein the columns are disposed vertically.

10. Apparatus for preparing and presenting successive columns of aligned, resilient, batts for packaging, comprising:

an ejection chamber having an opening providing entry for the front end of a column of batts;

a reception station for batts spaced from said ejection chamber;

a duct communicating between said reception station and said ejection chamber;

a platen; providing:

means for disposing said platen at said reception station at the commencement of one cycle of operations;

means for delivering batts to said reception station and for depositing them on the platen with the delivery and deposit of the batts being effected in a continuous movement substantially in one plane;

means for advancing the platen from said reception station through said duct towards said ejection chamber while a batt column is being formed thereon;

means for positioning the platen to occlude the opening in the ejection chamber while batts contained in the chamber are being expelled therefrom;

means for thereafter withdrawing the platen from chamber-occluding position and for transporting it exteriorly of said duct for re-disposal at said reception station at the commencement of another cycle of operations;

a companion platen, and mechanism for procuring functioning of said companion platen similarly in all respects to the first recited platen;

said platens functioning alternately with each other in overlapping cycles of operation.

11. The apparatus as claimed in claim 10 wherein the platen is disposable at the reception station and withdrawable from chamber-occluding position by said mechanism in directions normal to the axis of the duct.

12. Apparatus in accordance with claim 10 wherein the platen advancing means is operable in steps timed to correspond to the deposit of batts on the platen; said steps being spaced commensurately with the thickness of the batts.

13. Apparatus in accordance with claim 11 wherein said mechanisms are respectively capable of disposing and withdrawing the said respective platens and transporting them back to said reception station from different sides of the duct.

14. The apparatus in accordance with claim 13, wherein said different duct sides are opposite each other.

15. The apparatus in accordance with claims 10, 11 or 12 wherein said duct is disposed vertically.

* * * * *